US005515140A

United States Patent [19]

Atsumi et al.

[11] Patent Number: 5,515,140

[45] Date of Patent: May 7, 1996

[54] IMAGE FORMING APPARATUS FOR CHANGING PRE-PROCESSING CONDITION OF IMAGE CARRIER BASED ON PAPER FEED POSITION

[75] Inventors: Tetsuya Atsumi, Tokyo; Hisashi Fukushima, Kawasaki, both of Japan

[73] Assignee: Canon Kabushiki Kaisha, Tokyo, Japan

[21] Appl. No.: 407,683

[22] Filed: Mar. 21, 1995

[30] Foreign Application Priority Data

Mar. 25, 1994 [JP] Japan ..... 6-055509

[51] Int. Cl.[6] ..... G03G 15/05; G03G 15/01; G03G 21/14

[52] U.S. Cl. ..... 355/208; 355/219; 355/309; 355/326 R

[58] Field of Search ..... 355/208, 219, 355/309, 326 R, 308, 311

[56] References Cited

U.S. PATENT DOCUMENTS 4,456,370 6/1984 Hayes .
4,480,909 11/1984 Tsuchiya .
4,512,652 4/1985 Buck et al. .
5,029,314 7/1991 Katsumi et al. ..... 355/208
5,285,246 2/1994 Danzuka et al. .
5,296,903 3/1994 Suzuki et al. .
5,303,006 4/1994 Mizude ..... 355/208
5,410,390 4/1995 Miura et al. .

*Primary Examiner*—R. L. Moses
*Attorney, Agent, or Firm*—Fitzpatrick, Cella, Harper & Scinto

[57] ABSTRACT

An image forming apparatus is provided with an image carrier which rotates while carrying an electrostatic latent image, developer for developing the electrostatic latent image on the image carrier, transfer drum for transferring the developed image on the image carrier onto a recording medium in a transfer unit, a first storage unit for storing a recording medium to be fed to the transfer unit, and a second storage unit for storing a recording medium to be fed to the transfer unit, the second storage unit having a short feed time to the transfer unit. An electrostatic latent image forming condition is changed in correspondence with the number of revolutions of the image carrier, and a change in electrostatic latent image forming condition is controlled in correspondence with the storage unit which stores the recording medium to be fed.

10 Claims, 10 Drawing Sheets

IMAGE FORMING APPARATUS FOR CHANGING PRE-PROCESSING CONDITION OF IMAGE CARRIER BASED ON PAPER FEED POSITION

BACKGROUND OF THE INVENTION

1. Field of the Invention

The present invention relates to an image forming apparatus such as a copying machine, printer, or the like and, more particularly, to an electrophotography type or electrostatic recording type image forming apparatus.

2. Description of the Related Art

Conventionally, electrophotography type or electrostatic recording type image forming apparatuses for forming an electrostatic latent image on an image carrier, and developing the electrostatic latent image with a toner have been popularly used.

In recent years, apparatuses for forming full-color images have also been popularly used.

FIG. 7 shows an example of an electrophotography type full-color image forming apparatus.

In a color image forming apparatus shown in FIG. 7, a photosensitive drum 1 as an image carrier is supported to be rotatable in the arrow in FIG. 7 arrow in FIG. 7. A pre-exposure lamp 11, a corona (primary) charger 2, an optical system 3, a developing device 4, a transfer device 5, and a cleaning device 6 are arranged around the photosensitive drum 1.

The optical system 3 comprises, e.g., a laser beam exposure device which is constituted by an original such as a document scanning unit and color-separation filters, and irradiates color-separated optical images or a corresponding optical image E onto the photosensitive drum 1.

An optical image E is irradiated onto the photosensitive drum 1, which is charge-removed by the pre-exposure lamp 11 and is then uniformly charged by the primary charger 2, in units of separated colors, thereby forming a latent image. The developing device 4 comprises rotary of developers. More specifically, four developers, i.e., a black developer 4K, a cyan developer 4C, a magenta developer 4M, and a yellow developer 4Y are arranged on a rotary member 4*a*, which rotates about a central shaft 4*b*. A predetermined developer is rotated to a developing position opposing the photosensitive drum 1 to develop the latent image on the photosensitive drum 1, thereby forming a toner image on the photosensitive drum 1 using a resin-based toner.

Furthermore, the toner image on the photosensitive drum 1 is transferred onto a recording medium which is supplied from a recording medium cassette 7 (one of cassettes 7*a*, 7*b*, and 7*c*) to a position opposing the photosensitive drum 1 via a convey system and the transfer device 5 along a paper path indicated by a dotted line in FIG. 7.

In this example, the transfer device 5 comprises a transfer drum 5*a*, a transfer corona charger 5*b*, an attraction roller 5*g* opposing an attraction corona charger 5*c* for electrostatically attracting a recording medium, an inner corona charger 5*d*, and an outer corona charger 5*e*. A cylindrical recording medium carrier sheet 5*f* consisting of a dielectric integrally extends on a circumferential aperture region of the transfer drum 5, which is rotatably and axially supported.

As the transfer drum 5*a* rotates, the toner image on the photosensitive drum 1 is sequentially transferred onto a recording medium carried on the recording medium carrier sheet 5*f* by the transfer charger 5*b*. A desired number of color images are transferred onto the recording medium attracted on the recording medium carrier sheet 5*f*, thus forming a full-color image.

Upon completion of the desired number of toner images, the recording medium is peeled from the transfer drum 5*a* by a peeling means 8, and is exhausted onto a tray 10 via a thermal roller fixing device 9.

On the other hand, after the transfer operation, the residual toner on the surface of the photosensitive drum 1 is cleaned by the cleaning device 6, and thereafter, the photosensitive drum 1 is subjected to image forming processes again. The recording medium carrier sheet 5*f* extending on the transfer drum 5*a* is charge-removed by the inner and outer corona chargers 5*d* and 5*e*.

FIG. 8 is a timing chart showing the operation timings of the respective units in image formation in the image forming apparatus described above. An actual image forming operation is started after an ITOP signal for determining the position of the transfer drum 5*a* is detected.

During rotation of the photosensitive drum prior to the image formation starting from laser exposure, the photosensitive drum is subjected to pre-exposure and primary charging over one revolution to stabilize the potential (the rotation of the image carrier which is performed before image formation for the purpose of stabilizing the charged potential by charge removal and charging over one revolution will be referred to as the rotation for stabilizing the potential hereinafter).

However, when a large-diameter photosensitive drum which has a circumferential length ratio of 1:1 with respect to the transfer drum is used, or when the apparatus is rendered compact, the convey time of a recording medium from the paper feed cassette to the transfer device may become shorter than the time required for one revolution of the photosensitive drum.

In this case, the photosensitive drum must be rotated by one extra revolution to attain the above-mentioned rotation for stabilizing the potential, and the first image forming time (to be referred to as "FCOT" hereinafter) after the rest time is undesirably prolonged.

SUMMARY OF THE INVENTION

It is an object of the present invention to provide an image forming apparatus which has a transfer medium storage unit which has a shorter feed distance to a transfer unit than the circumferential length of an image carrier.

It is another object of the present invention to provide an image forming apparatus which can shorten the FCOT after the rest time.

It is still another object of the present invention to provide an image forming apparatus comprising:

- an image carrier which rotates while carrying an electrostatic latent image;
- developing means for developing the electrostatic latent image on the image carrier;
- transfer means for transferring the developed image on the image carrier onto a recording medium in a transfer unit;
- a first storage unit for storing a recording medium to be fed to the transfer unit;
- a second storage unit for storing a recording medium to be fed to the transfer unit, the second storage unit having a short feed time to the transfer unit;

changing means for changing an electrostatic latent image forming condition in correspondence with the number of revolutions of the image carrier; and control means for controlling a change in electrostatic latent image forming condition by the changing means in correspondence with the storage unit which stores the recording medium to be fed.

Other objects of the present invention will become apparent from the following description.

DETAILED DESCRIPTION OF THE PREFERRED EMBODIMENTS

An embodiment of the present invention will be described hereinafter.

Figure 1:
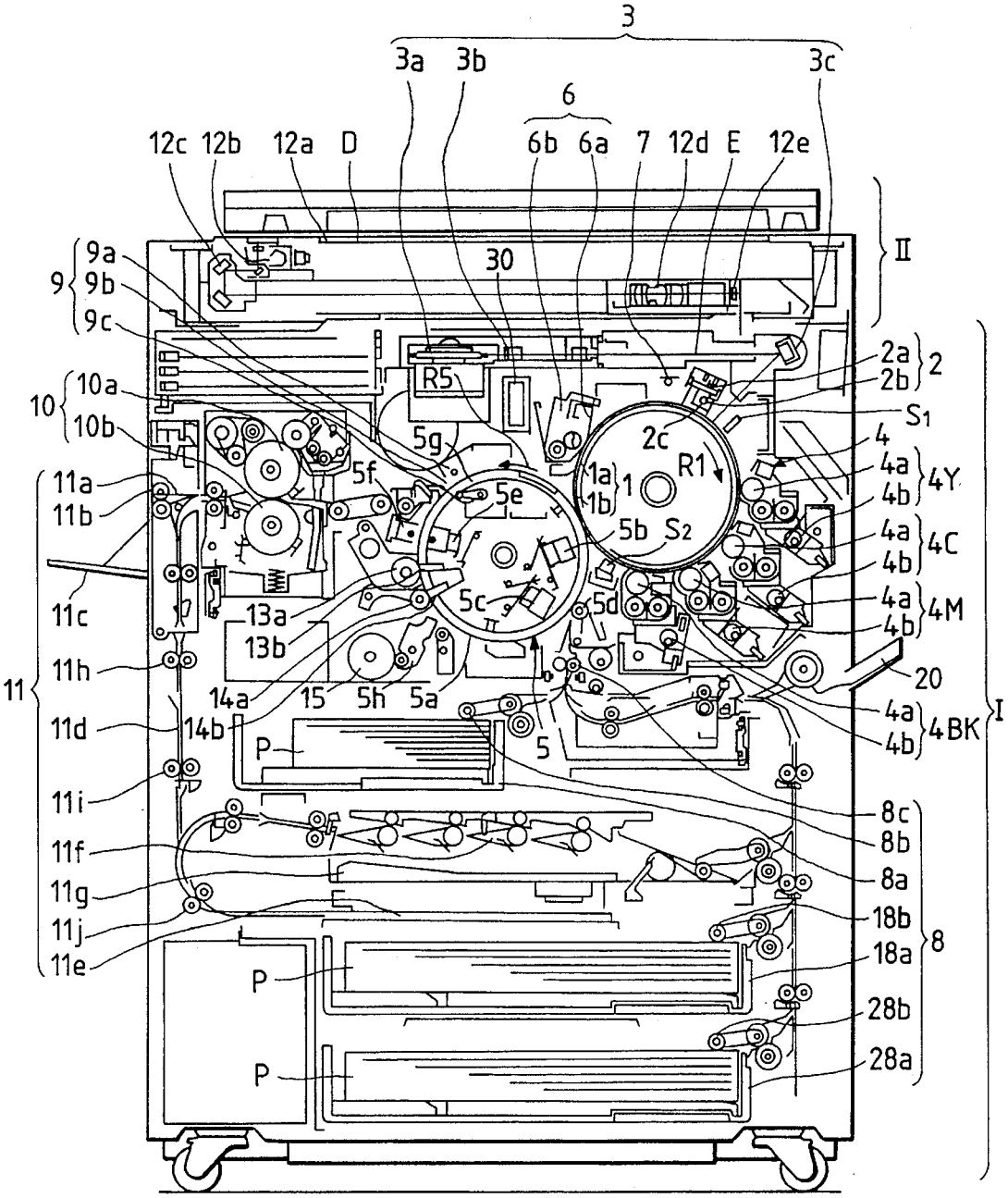
FIG. 1 is a sectional view of an image forming apparatus according to an embodiment of the present invention.

FIG. 1 is a sectional view of an electrophotography type digital full-color copying machine as an image forming apparatus according to an embodiment of the present invention.

The image forming apparatus shown in FIG. 1 comprises a digital color-image printer unit (to be simply referred to as a "printer unit" hereinafter) I in its lower portion, and a digital color-image reader unit (to be simply referred to as a "reader unit" hereinafter) II in its upper portion. For example, the apparatus forms an image on a recording medium P using the printer unit I on the basis of an image of a document D read by the reader unit II.

The arrangement of the printer unit I and the arrangement of the reader unit II will be described in turn below.

The printer unit I has a photosensitive drum 1 as an image carrier, which has a diameter of 180 mm and is rotated in the direction of an arrow R1 in FIG. 1. A primary charger (charging means) 2, an exposure means 3, a developing device (developing means) 4, a transfer device 5, a cleaning device 6, a pre-exposure lamp 7, and the like are arranged in the order around the photosensitive drum 1 along the rotating direction of the drum 1. A paper feed/convey unit 8 of a recording medium P is arranged below the transfer device 5, i.e., in the lower half portion of the printer unit I. A peeling means 9 is arranged above the transfer device 5. In addition, a fixing device 10 and a paper exhaust unit 11 are arranged on the downstream side (the downstream side in the convey direction of the recording medium P) of the peeling means 9.

The photosensitive drum 1 comprises an aluminum drum-shaped base body 1*a*, and an OPC (organic photo-semiconductor) photosensitive body 1*b*, and is rotated at a predetermined process speed (peripheral velocity) in the direction of the arrow R1 by a driving means (not shown).

The primary charger 2 is a corona charger which comprises a shield 2*a* which has an opening at a portion opposing the photosensitive drum 1, a discharge wire 2*b* which is arranged inside the shield 2*a* to extend parallel to the generator of the photosensitive drum 1, and a grid 2*c* which is arranged in the opening portion and regulates the charging potential. The primary charger 2 is applied with a charging bias from a power supply (not shown), and charges the surface of the photosensitive drum to a predetermined negative potential.

The exposure means 3 comprises a laser output unit (not shown) for emitting a laser beam on the basis of an image signal from the reader unit II (to be described later), a polygonal mirror 3*a* for reflecting the laser beam, a lens 3*b*, and a mirror 3*c*. The exposure means 3 exposes the surface of the photosensitive drum 1 to the irradiated laser beam to remove the charge on the exposed portion, thereby forming an electrostatic latent image. That is, the exposure means performs a so-called image scan exposure operation. In this embodiment, electrostatic latent images to be formed on the surface of the photosensitive drum 1 are color-separated into four colors, i.e., yellow, cyan, magenta, and black on the basis of an image of a document, and electrostatic latent images corresponding to the respective colors are sequentially formed.

The developing device 4 comprises four developers, i.e., developers 4Y, 4C, 4M, and 4Bk which respectively store yellow, cyan, magenta, and black resin-based toners (developing agents), in turn from the upstream side along the rotating direction (the direction of the arrow R1) of the photosensitive drum 1. Each of the developers 4Y, 4C, 4M, and 4Bk has a developing sleeve 4*a* for attaching a toner onto an electrostatic latent image formed on the surface of the photosensitive drum 1. The developer of a predetermined color to be subjected to development of an electrostatic latent image is alternatively located at the developing position in the vicinity of the surface of the photosensitive drum 1 by a corresponding eccentric cam 4*b*, and attaches a negative toner onto the electrostatic latent image via the developing sleeve 4*a*, thus forming a toner image as a visible image. Note that the remaining three color developers other than one to be subjected to development are retracted from the developing position.

The transfer device 5 has a transfer drum (recording medium carrier) 5*a* for carrying a recording medium P on its surface, a transfer brush charger (transfer means) 5*b* for transferring a toner image on the photosensitive drum 1 onto the recording medium P, an attraction brush charger 5*c* for attracting the recording medium P onto the transfer drum 5*a*, an attraction roller 5*d* opposing the charger 5*c*, an inner corona charger 5*e*, and an outer corona charger 5*f*. A cylindrical recording medium carrier sheet 5*g* consisting of a dielectric integrally extends on a circumferential opening region of the transfer drum 5*a*, which is axially supported to be rotatable in the direction of an arrow R5 in FIG. 1. The recording medium carrier sheet 5*g* adopts a dielectric sheet such as a polycarbonate film. The transfer device 5 carries the recording medium P attracted on the surface of the transfer drum 5*a*.

The cleaning device 6 comprises a cleaning blade 6*a* for removing any residual toner which is not transferred onto the recording medium P and remains on the surface of the photosensitive drum 1, and a cleaning chamber 6*b* for recovering the removed toner.

The pre-exposure lamp 7 is arranged on the upstream side in the neighborhood of the primary charger 2, and removes an unnecessary charge on the surface of the photosensitive drum 1 cleaned by the cleaning device 6.

The paper feed/convey unit 8 comprises a plurality of paper feed cassettes 8*a* for storing stacks of recording media P with different sizes, a paper feed roller 8*b* for feeding a recording medium P in each paper feed cassette 8*a*, a large number of convey rollers, registration rollers 8*c*, and the like, and supplies a recording medium P with a predetermined size to the transfer drum 5*a*.

The peeling means 9 comprises a peeling charger 9*a* for peeling the recording medium P, on which toner images have been transferred, from the transfer drum 5*a*, a peeling pawl 9*b*, a peeling push-up roller 9*c*, and the like.

The fixing device 10 comprises a fixing roller 10*a* which has an internal heater, and a compression roller 10*b* which is arranged below the fixing roller 10*a* and presses the recording medium P against the fixing roller 10*a*. The fixing device 10 performs heating compression while clamping the recording medium between the two rollers 10*a* and 10*b*. The convey speed (to be referred to as a "fixing convey speed" hereinafter) of the recording medium P by the fixing device 10 changes depending on the thickness of the recording medium P, a single- or double-sided image formation mode, and the like.

The paper exhaust unit 11 comprises a convey path selector guide 11*a*, exhaust rollers 11*b*, a paper exhaust tray 11*c*, and the like which are arranged on the downstream side of the fixing device 10. Below the convey path selector guide 11*a*, a vertical convey path 11*d*, a reversal path 11*e*, a stacking member 11*f*, an intermediate tray 11*g*, convey rollers 11*h* and 11*i*, reversal rollers 11*j*, and the like, which are used for performing image formation on two surfaces of a single recording medium P, are arranged.

Around the photosensitive drum 1, a potential sensor $S_1$ for detecting the charged potential on the surface of the photosensitive drum is arranged between the primary charger 2 and the developing device 4, and a density sensor for detecting the density of a toner image on the photosensitive drum 1 is arranged between the developing device 4 and the transfer drum 5*a*.

The reader unit II will be described below. The reader unit II arranged above the printer unit I comprises a document table glass 12*a* on which a document D is placed, an exposure lamp 12*b* for exposing an image surface of the document D while being scanned, a plurality of mirrors 12*c* for reflecting light reflected by the document D, a lens 12*d* for focusing the reflected light, a full-color sensor 12*e* for forming color-separated image signals on the basis of the light from the lens 12, and the like. The color-separated image signals are processed by a video processing unit (not shown) via an amplifier circuit (not shown), and the processed signals are output to the above-mentioned printer unit I.

The operation of the image forming apparatus with the above-mentioned arrangement will be briefly described below together with a brief description of the arrangement. In the following description, a full-color image defined by four colors is formed in the order of yellow, cyan, magenta, and black images.

An image on a document D placed on the document table glass 12*a* of the reader unit II is irradiated with light emitted from the exposure lamp 12*b*, and is color-separated. First, a yellow image is read by the full-color sensor 12*e*, and is subjected to predetermined processing. The processed signal is supplied to the printer unit I as an image signal.

In the printer unit I, the photosensitive drum 1 is rotated in the direction of the arrow R1, and its surface is charged to a predetermined negative potential by the primary charger 2. On the basis of the above-mentioned image signal supplied from the reader unit II, a laser beam output from the laser output unit of the exposure means 3 is converted into an optical signal for the image scan exposure operation, and the converted laser beam is irradiated, thereby exposing the charged surface of the photosensitive drum 1 to an optical image E via the polygonal mirror 3*a*, and the like. Any charge is removed from the exposed portion on the surface of the photosensitive drum 1, thus forming an electrostatic latent image corresponding to the yellow image. In the developing device 4, the yellow developer 4Y is located at the predetermined developing position, and the remaining developers 4C, 4M, and 4Bk are retracted from the developing position. The electrostatic latent image on the photosensitive drum 1 is visualized by a yellow negative toner supplied from the developer 4Y, thus obtaining a negative toner image. The yellow toner image on the photosensitive drum 1 is transferred onto a recording medium P carried on the transfer drum 5*a*. The recording medium P having a size suitable for a document image is supplied from the predetermined paper feed cassette 8*a* (18*a*, 28*a*) to the transfer drum 5*a* via the paper feed roller 8*b* (18*b*, 28*b*), the convey rollers, the registration rollers 8*c*, and the like after detection of B-ITOP. The recording medium P which is supplied as described above is attracted on the surface of the transfer drum 5*a* to be wound therearound, and is rotated in the direction of the arrow R5. The yellow toner image on the photosensitive drum 1 is transferred then onto the recording medium P by the transfer corona charger 5*b*.

On the other hand, after the toner image is transferred, the residual toner on the surface of the photosensitive drum 1 is removed by the cleaning device 6, and an unnecessary charge is removed by the pre-exposure lamp 7 to prepare for the next image formation starting from primary charging.

The above-mentioned processes, i.e., the reading operation of a document image by the reader unit II, the transfer operation of a toner image onto the recording medium P on the transfer drum 5*a*, the cleaning and charge removal operations of the photosensitive drum 1 are repeated for the remaining colors other than yellow, i.e., cyan, magenta, and black, and four toner images are transferred onto the recording medium P on the transfer drum 5*a* to overlap each other.

The recording medium P on which the four color toner images have been transferred is peeled from the transfer drum 5*a* by the peeling charger 9*a*, the peeling pawl 9*b*, and the like, and is conveyed to the fixing device 10 while carrying non-fixed toner images on its surface. The recording medium P is heated and compressed by the transfer roller 10*a* and the compression roller 10*b* of the fixing device 10, so that the toner images on its surface melt and are fixed. The recording medium P after the fixing operation is exhausted onto the paper exhaust tray 11*c* by the exhaust rollers 11*b*. In this manner, image formation for one surface (first surface) of the recording medium P is completed. When images are to be formed on two surfaces (first and second surfaces) of the recording medium P, the recording medium P exhausted from the fixing device 10 is temporarily guided to the reversal path 11*e* via the vertical convey path 11*d* by immediately driving the convey path selector guide 11*a*, and thereafter, exits the reversal path 11*e* in a direction opposite to the feed direction, with its back edge upon feeding leading, by rotating the reversal rollers 11*j* in the reverse direction. The recording medium P is then stored in the intermediate tray 11*g*. Thereafter, an image is formed on the other surface (second surface) of the recording medium P by the above-mentioned image forming process.

Upon completion of transfer of the toner images on the second surface, after the process speed of the photosensitive drum 1 is lowered, the recording medium P is peeled from the transfer drum 5*a*. The recording medium P is subjected to fixing in the fixing device 10 after the fixing convey speed is lowered from a single-sided (first surface) speed to a double-sided (second surface in the double-sided image formation mode) speed. After the fixing operation, the recording medium P is exhausted onto the paper exhaust tray 11*c*, thus completing double-sided image formation.

In order to prevent scattering and attachment of toner powder onto the recording medium carrier sheet 5*g*, attachment of oil onto a recording medium P, and the like, the surface of the transfer drum 5*a* after peeling of the recording medium P is cleaned using a fur brush 13*a* and a backup brush 13*b*, and an oil removal roller 14*a* and a backup brush 14*b*, which oppose each other via the recording medium carrier sheet 5*g*. Note that such a cleaning operation is performed before or after image formation, or is performed as needed when a jam paperjam occurs.

In this embodiment, the gap between the recording medium carrier sheet 5*g* and the photosensitive drum 1 can be arbitrarily set by operating an eccentric cam 15 at a desired timing to operate a cam follower 5*h* integrated with the transfer drum 5*a*. During a standby state or while the power supply is kept OFF, if a charge remains on the transfer drum 5*a*, this charge acts on the photosensitive drum 1 to generate a charging memory, thus deteriorating image quality in image formation later. For this reason, the gap between the transfer drum 5*a* and the photosensitive drum 1 is widened in such a state.

The rotation of the photosensitive drum 1 is stopped after the process speed of the transfer drum 5*a* from which the recording medium P has been peeled is recovered to that in a normal image formation mode. The transfer roller 5*a* rotates while it is pressed against the photosensitive drum 1. For this reason, when the transfer drum 5*a* is separated from the photosensitive drum 1, the transfer drum 5*a* is controlled to stop at a predetermined position.

Figure 2:
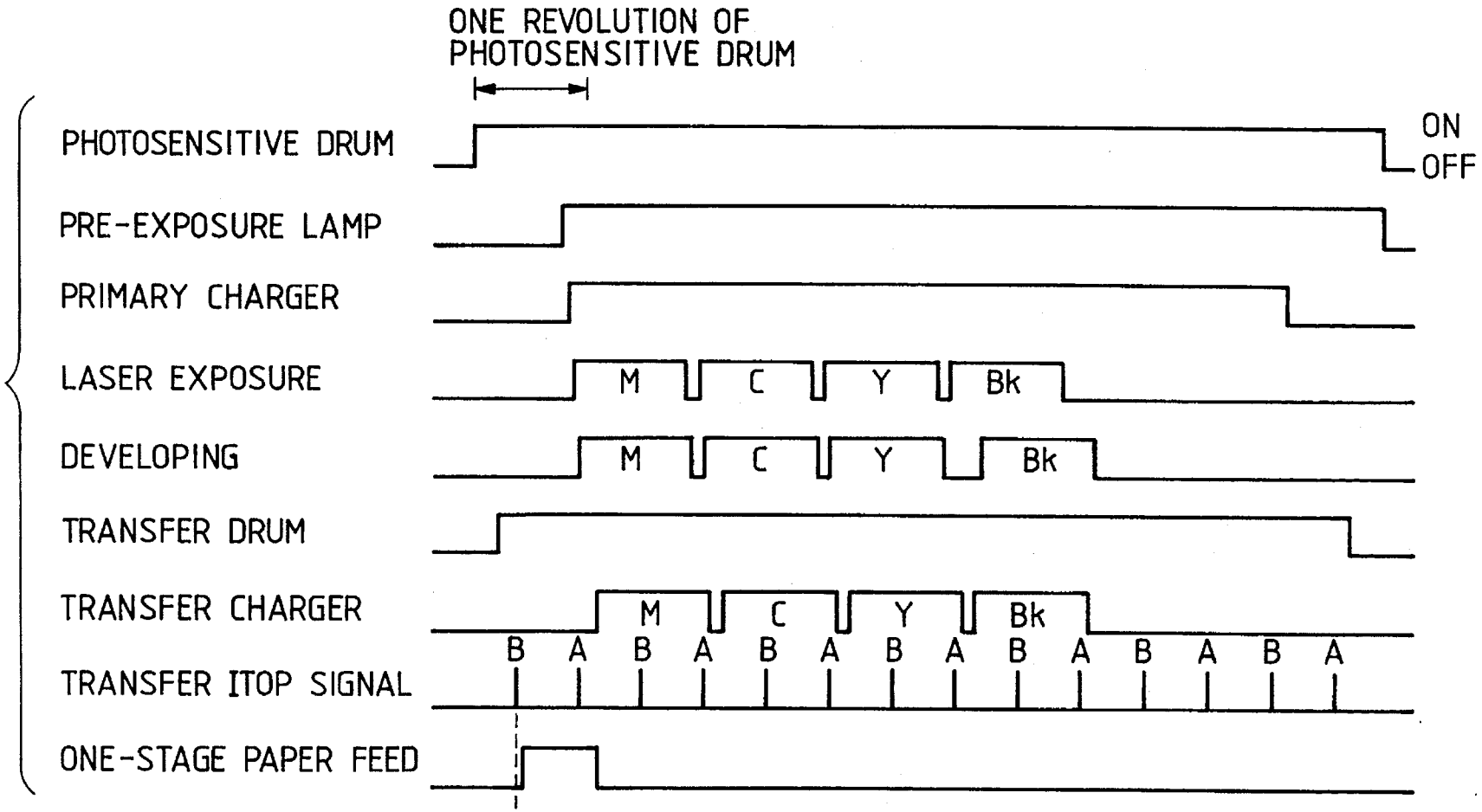
FIGS. 2 and 3 are timing charts showing the operation according to the embodiment of the present invention.

FIG. 2 is a timing chart upon image formation onto a recording medium which is fed from the one-stage cassette 8*a* to the transfer unit for the recording medium convey time shorter than the time required for one revolution of the photosensitive drum 1.

An A4-size paper sheet is fed from the paper feed cassette 8*a*, so that its short sides are substantially parallel to the convey direction.

Upon image formation onto a recording medium which is conveyed to the transfer unit for the recording medium convey time shorter than the time required for one revolution of the photosensitive drum, electrostatic image formation is started by laser exposure before the photosensitive drum is subjected to pre-exposure and charging for one revolution, thereby shortening the FCOT.

Figure 3:
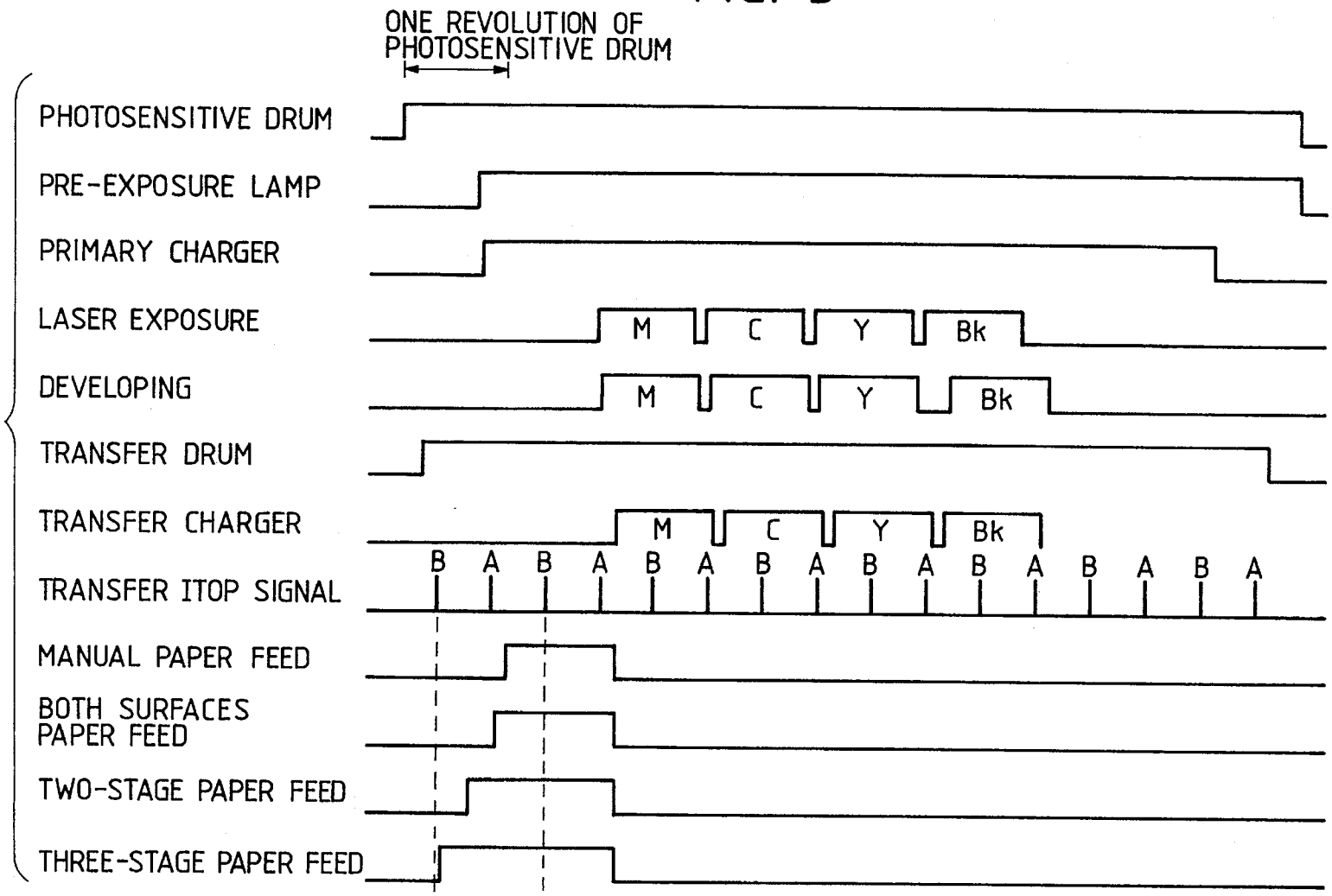

FIG. 3 is a timing chart upon image formation onto a recording medium which is fed from a manual paper insertion table 20 or a paper feed cassette 18*a* or 28*a* to the transfer unit for the recording medium convey time longer than the time required for one revolution of the photosensitive drum.

The paper feed cassettes 18*a* and 28*a* store recording media having larger lengths, in the convey direction, than that of recording media stored in the paper feed cassette 8*a*.

Upon image formation onto a recording medium having a larger length in the convey direction, electrostatic image formation is started after the photosensitive drum is subjected to pre-exposure and charging over one revolution, thereby preventing a variation in potential of an electrostatic latent image during full-color image formation.

Figure 9A:
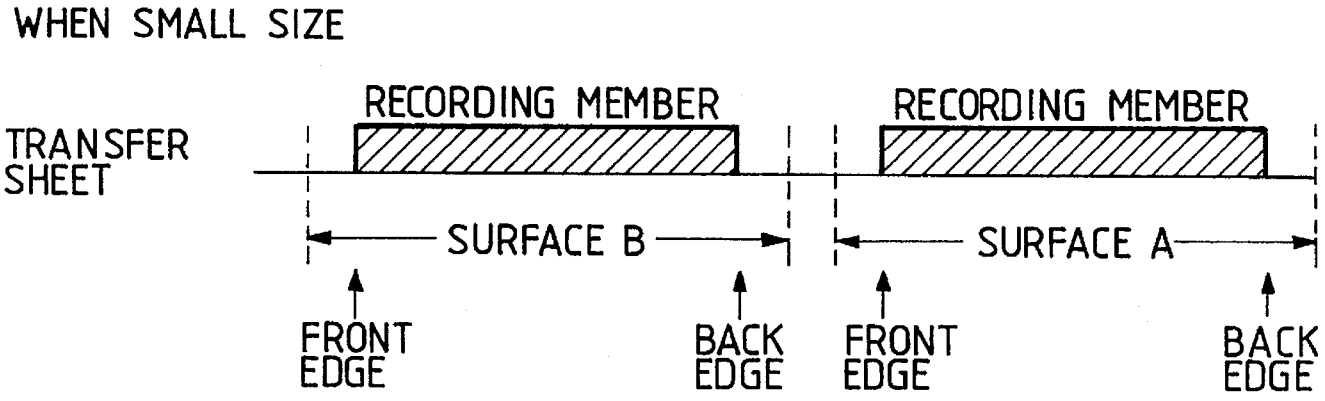
FIGS. 9A and 9B are schematic views showing the positions of paper sheets carried on a transfer sheet.
Figure 9B:
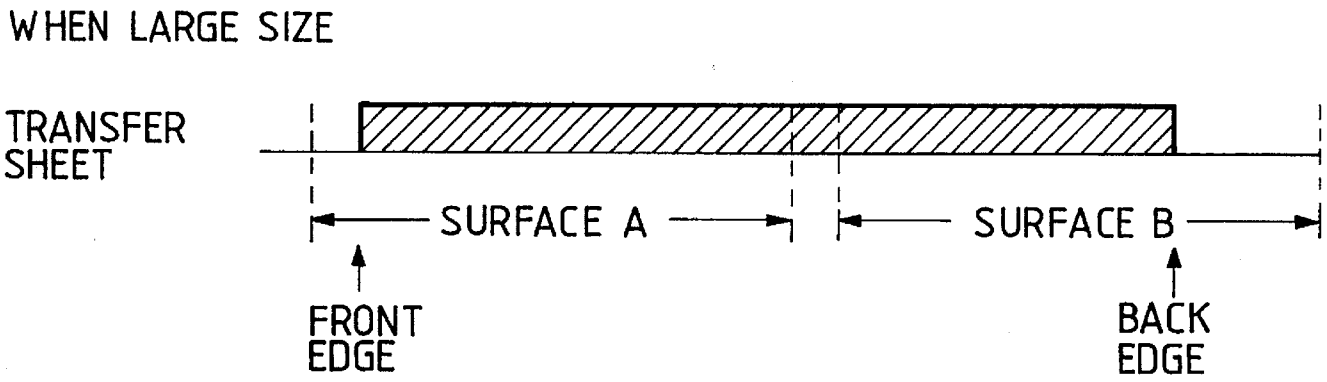
Figure 10:
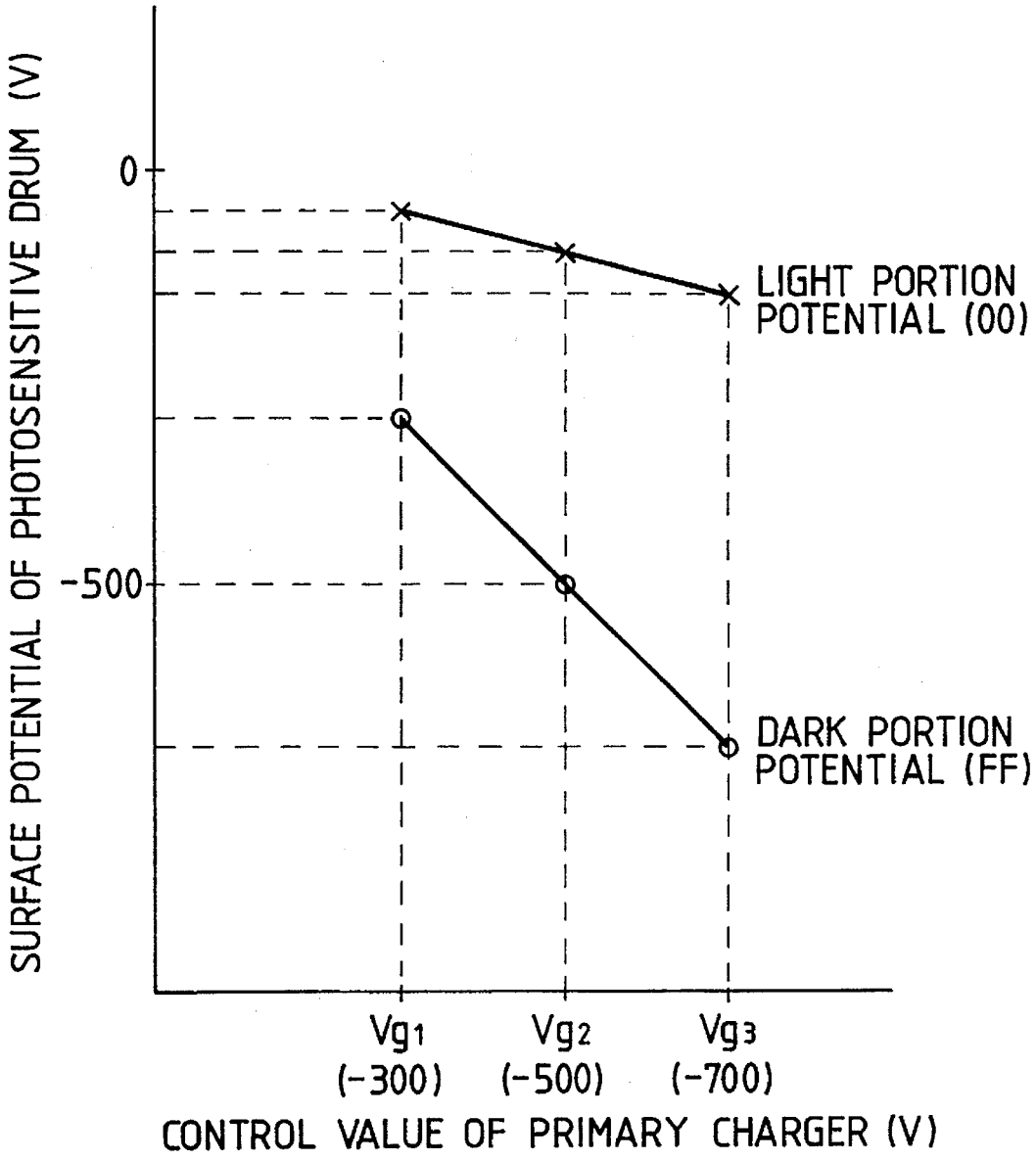
FIG. 10 is a graph showing the relationship between the charge control value and the drum surface potential.

When one portion of the carrier surface of the transfer drum is called an A surface, and the other portion is called a B surface, small-size sheets (A4, LETTER, and the like) are attracted onto the transfer drum in the order from the B surface, and large-size sheets (A4R, A3, B4, and the like) are attracted onto the transfer drum in the order from the A surface, as shown in FIGS. 9A and 9B, thereby preventing a local wear of the recording medium carrier sheet.

Figure 4:
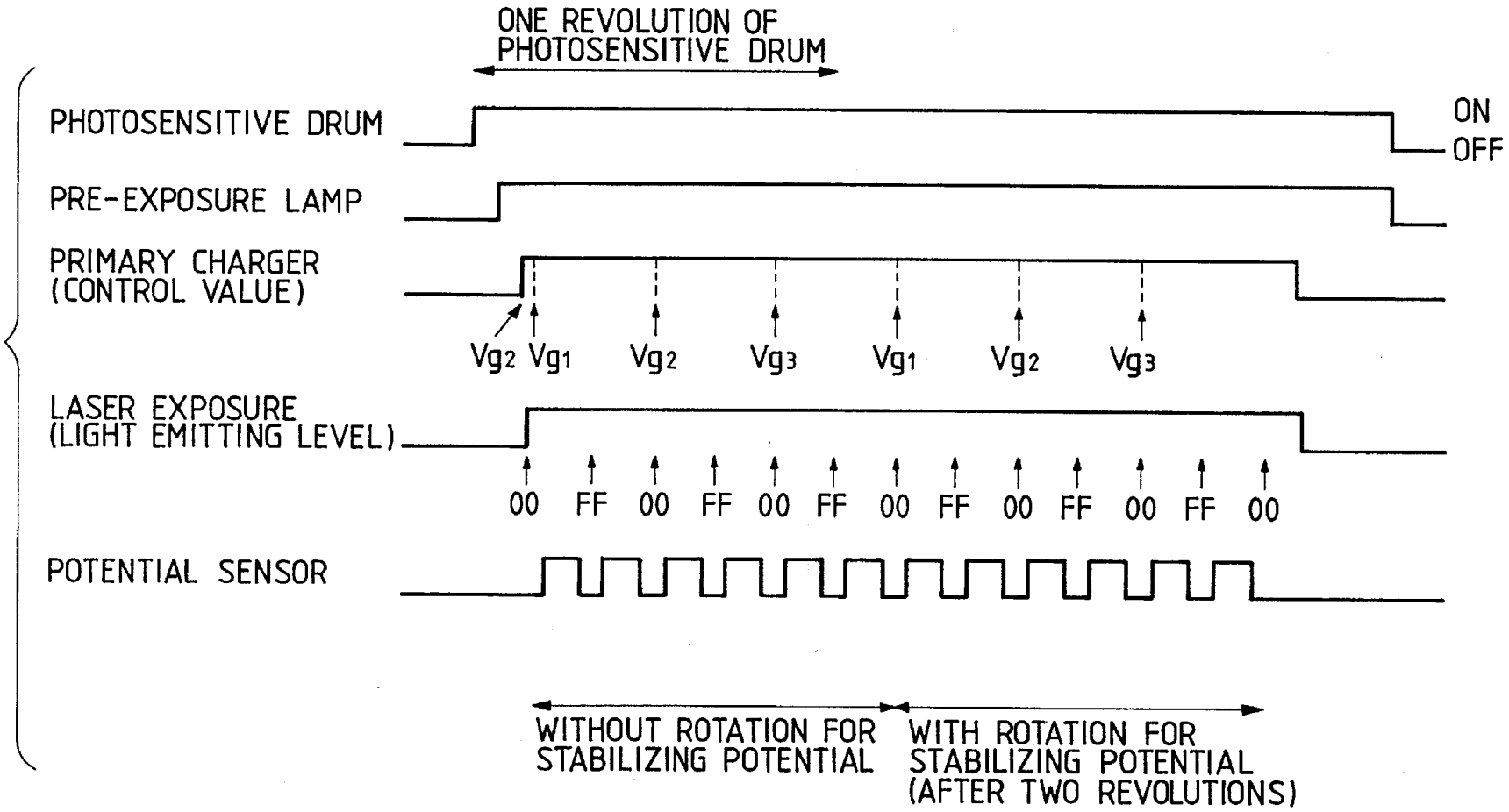
FIG. 4 is a chart showing a potential measurement sequence for determining an image forming condition.

The timing chart in FIG. 4 shows a method of determining the grid bias value of the primary charger for determining charging performance of the primary charger as an image forming condition during warming-up of the apparatus after a main switch is turned on.

During the first revolution of the photosensitive drum, the potentials of dark portions (OO) and light portions (FF) of charging regions with three grid bias levels $Vg_1$, $Vg_2$, and $Vg_3$ are detected by the potential sensor $S_1$, and an optimal grid bias is obtained on the basis of these detection outputs.

The grid bias obtained from the surface potential during the first revolution of the photosensitive drum is applied to a grid upon image formation onto a recording medium fed from the paper feed cassette 8*a*, thus performing image formation of the first color (magenta in this embodiment).

During the second revolution of the photosensitive drum, the grid bias is obtained in the same manner as in the first revolution.

The grid bias obtained from the surface potential during the second revolution of the photosensitive drum is applied to the grid upon image formation of the second and subsequent colors (cyan, yellow, and black in this embodiment) onto a recording medium fed from the manual paper insertion table 20 or the paper feed cassette 18*a* or 28*a*.

Figure 5:
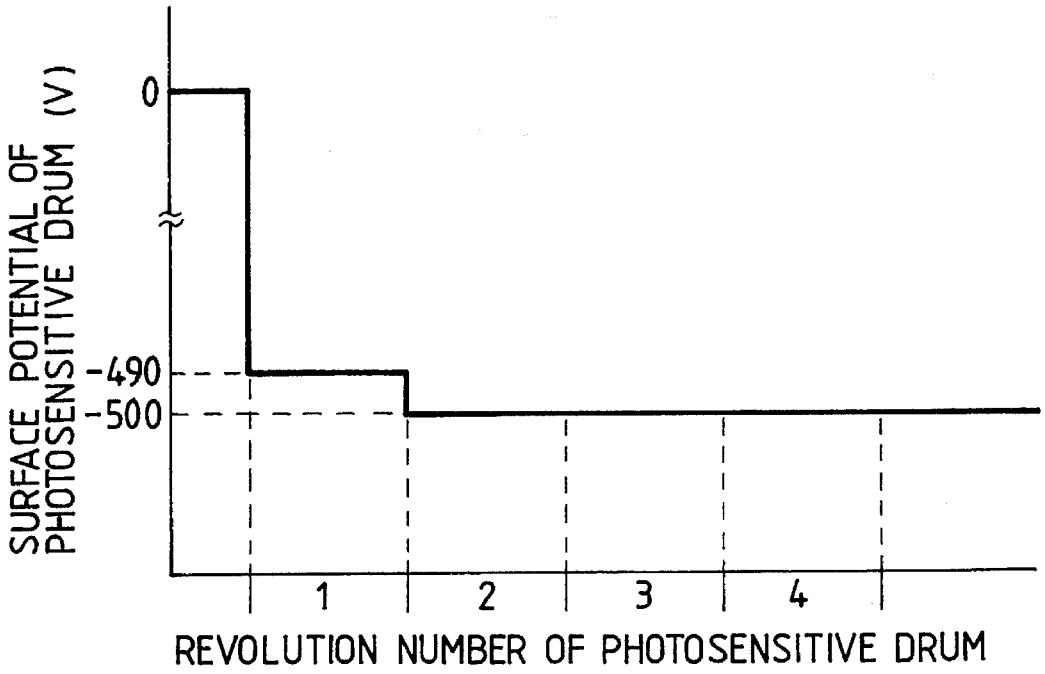
FIGS. 5 and 6 are graphs showing the surface potential of a photosensitive drum.

Normally, when predetermined control is made based on the measurement value during the rotation for stabilizing the potential so as to obtain a uniform surface potential of the photosensitive drum regardless of the number of revolutions of the photosensitive drum, a potential difference of about 10 V is generated between the surface potentials during the first revolution and the second and subsequent revolutions of the photosensitive drum, as shown in FIG. 5. This potential difference appears as a difference in color tone on a full-color image (upon formation of monochrome images, an image on the first medium has a higher density than that of an image on the second medium).

Figure 6:
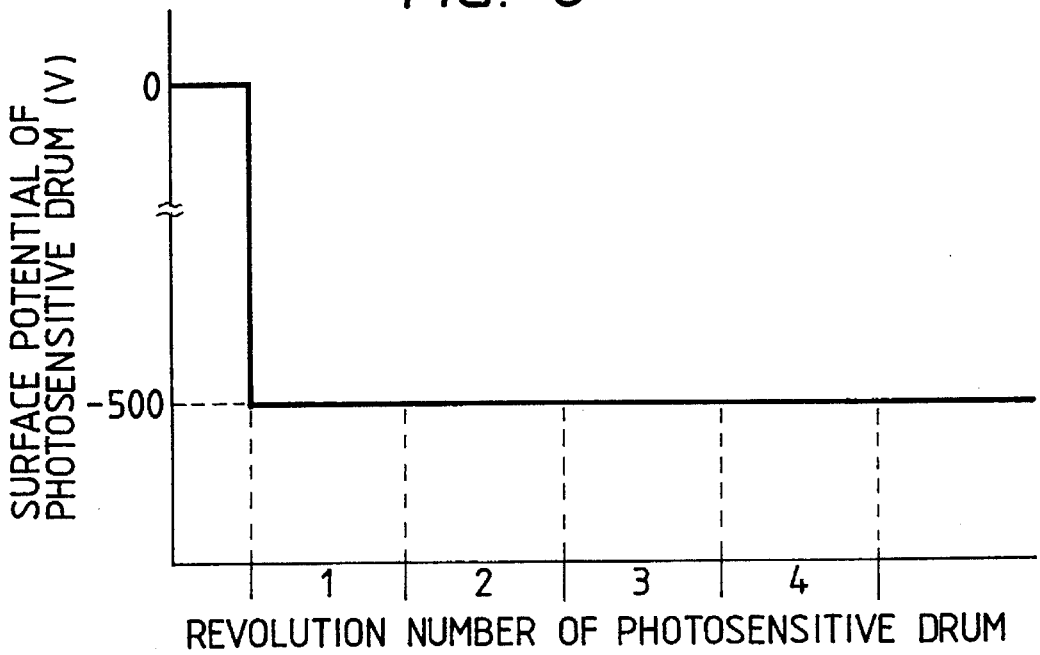

However, when optimal image forming conditions are used in correspondence with the presence/absence of the rotation for stabilizing the potential, a uniform surface potential of the photosensitive drum can be obtained, as shown in FIG. 6, and a density difference on images is not observed.

In this case, $Vg_1$=−300 V, $Vg_2$=−500 V, and $Vg_3$=−700 V.

Figure 11:
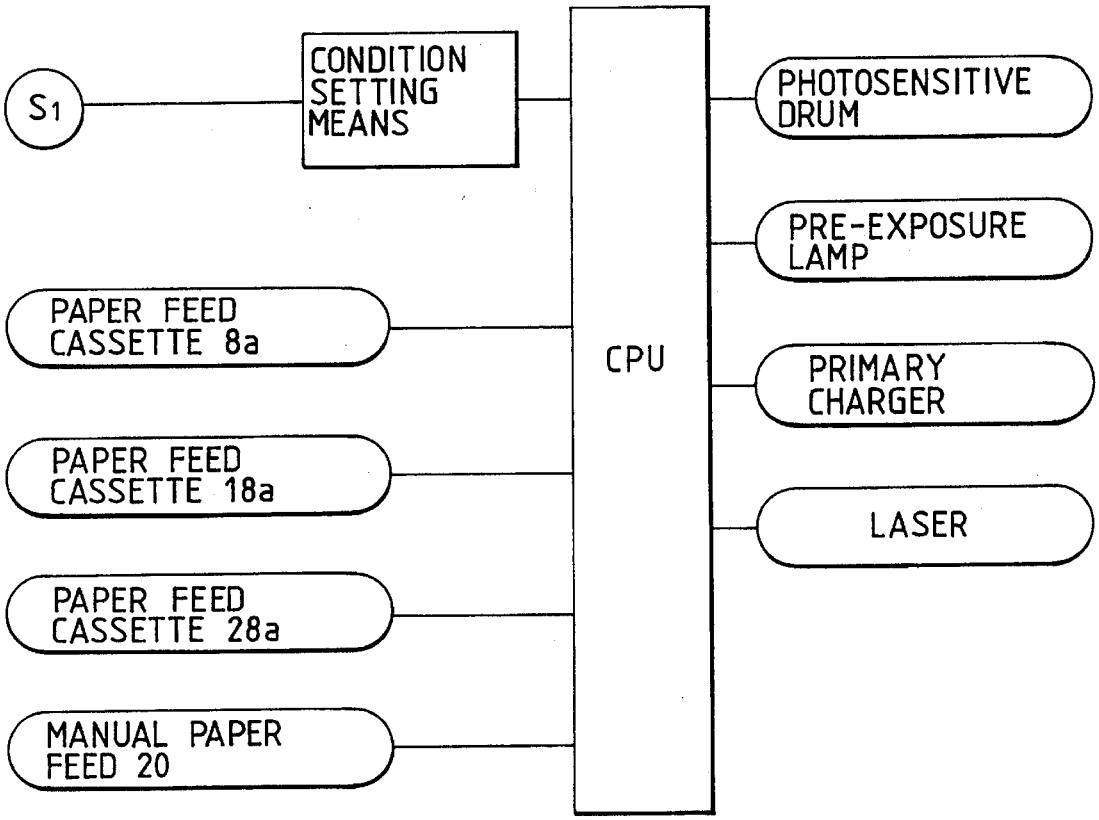
FIG. 11 is a block diagram showing the embodiment of the present invention.

Note that FIG. 11 is a block diagram showing the embodiment of the present invention.

The potential measurement for determining an image forming condition in the above embodiment is particularly effective for a case wherein a large-diameter photosensitive drum is used. On the other hand, the following method can be adopted for a small-diameter photosensitive drum. When a photosensitive drum has a diameter of 60 mm, one control potential ($Vg_2$) is measured in a state without rotation for stabilizing the potential, and after the potential is stabilized, the measurement is performed the same number of times as in the above embodiment. Any difference between the measurement values of $Vg_2$ with or without the rotation for stabilizing the potential is reflected in the measurement values of $Vg_1$ and $Vg_2$ after the rotation for stabilizing the potential, thus obtaining the same effect as in the above embodiment.

The embodiment of the present invention has been described. However, the present invention is not limited to the above embodiment, and various modifications may be made within the spirit and scope of the invention.

What is claimed is:

1. An image forming apparatus comprising:

an image carrier which rotates while carrying an electrostatic latent image;

developing means for developing the electrostatic latent image on said image carrier;

transfer means for transferring the developed image on said image carrier onto a recording medium in a transfer unit;

a first storage unit for storing a recording medium to be fed to the transfer unit;

a second storage unit for storing a recording medium to be fed to the transfer unit, said second storage unit having a short feed time to the transfer unit;

changing means for changing an electrostatic latent image forming condition in correspondence with the number of revolutions of said image carrier; and control means for controlling a change in electrostatic latent image forming condition by said changing means in correspondence with the storage unit which stores the recording medium to be fed.

2. An apparatus according to claim 1, wherein said image carrier comprises a photosensitive body, said apparatus further comprises charging means for uniformly charging said image carrier, and exposing means for exposing an image on said image carrier charged by said charging means, and said changing means changes charging capacity by said charging means.

3. An apparatus according to claim 2, wherein the photosensitive body consists of an organic photosensitive material.

4. An apparatus according to claim 1, wherein said image carrier has an end-less shape, and the feed time from the first storage unit to the transfer unit is longer than a time required for one revolution of said image carrier and is shorter than the feed time from the second storage unit to the transfer unit.

5. An apparatus according to claim 1, wherein a length, in a convey direction, of the recording medium stored in the first storage unit is larger than a length, in the convey direction, of the recording medium stored in the second storage unit.

6. An apparatus according to claim 2, wherein upon image formation on the recording medium fed from the second storage unit, said changing means lowers the charging capacity of said charging means after a predetermined number of revolutions of said image carrier.

7. An apparatus according to claim 1, wherein the predetermined number of revolutions is one.

8. An apparatus according to claim 1, wherein said developing means comprises a plurality of developers for storing different color developing agents, and said transfer means comprises a transfer rotary member for sequentially transferring developed images on said image carrier.

9. An apparatus according to claim 8, wherein upon formation of a full-color image on the recording medium fed from the second storage unit, said changing means changes an electrostatic latent image forming condition between the first color and the second and subsequent colors.

10. An apparatus according to claim 8, wherein a circumferential length of said image carrier is substantially equal to a circumferential length of said transfer rotary member.

* * * * *

UNITED STATES PATENT AND TRADEMARK OFFICE

CERTIFICATE OF CORRECTION

PATENT NO. : 5,515,140
DATED : May 7, 1996
INVENTOR(S) : TETSUYA ATSUMI, ET AL.

Figure 7:
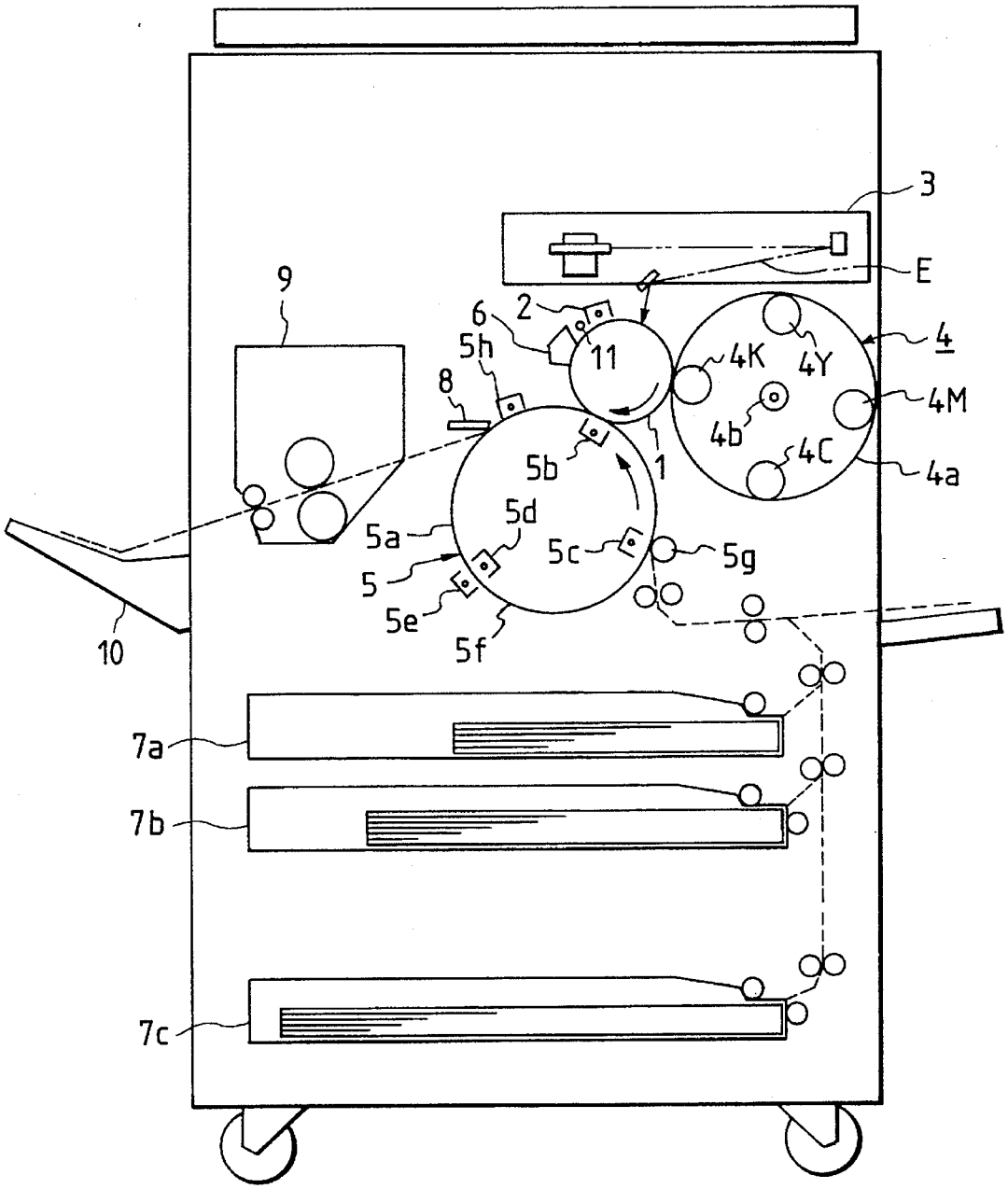
FIG. 7 is a schematic sectional view showing the arrangement of an image forming apparatus.
Figure 8:
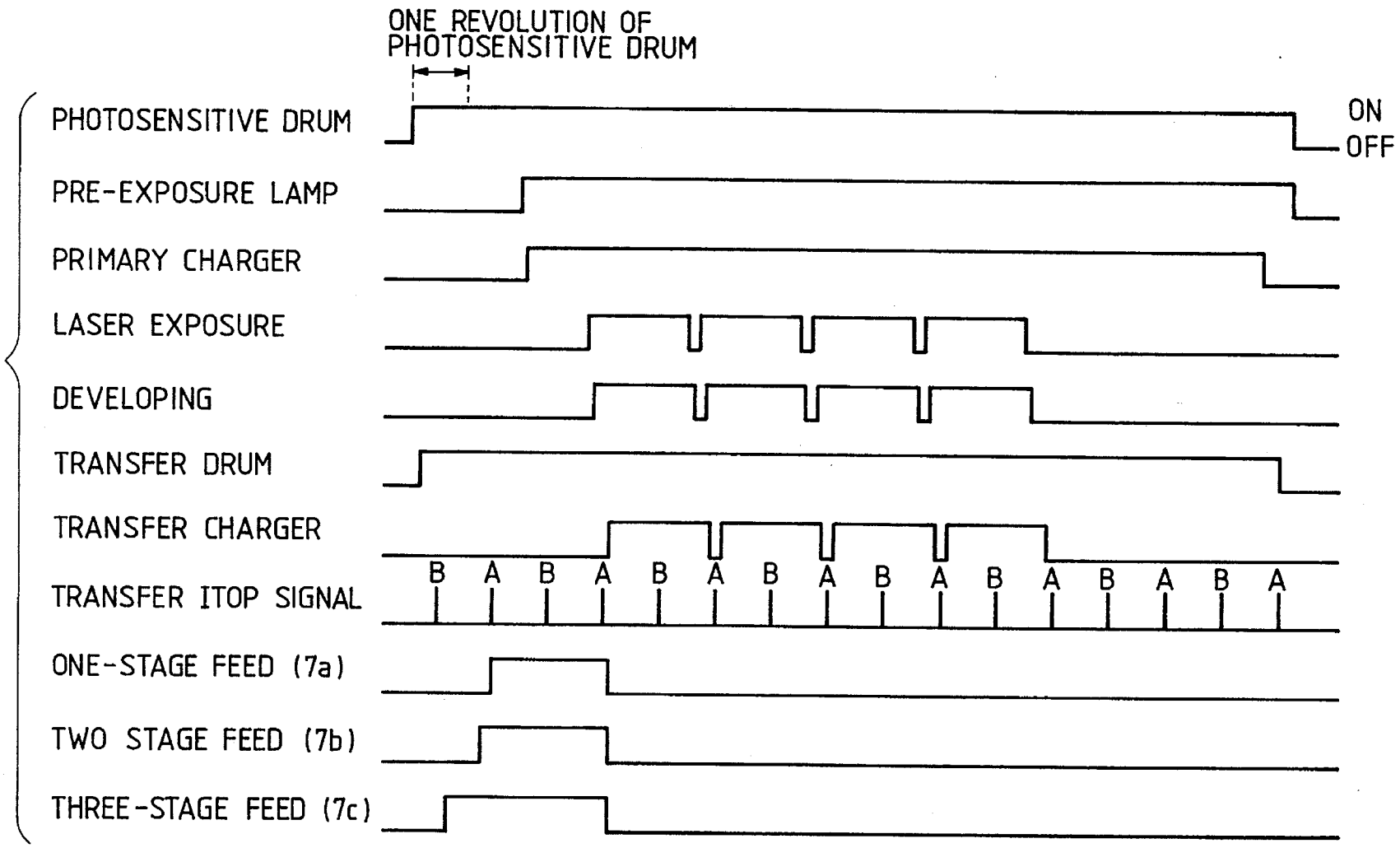
FIG. 8 is a timing chart showing the operations of respective members constituting the image forming apparatus shown in FIG. 7.

It is certified that error appears in the above-indentified patent and that said Letters Patent is hereby corrected as shown below:

Column 1,
line 26, "FIG. 7 arrow in Fig. 7." should read --FIG. 7.--; and
line 40, "of" should be deleted.

Column 6,
line 34, "transferred then" should read --then transferred--.

Column 7,
line 25, "jam paperjam" should read --(paper) jam--.

Column 10,
line 9, "end-less" should read --endless--.

Signed and Sealed this

Tenth Day of September, 1996

*Attest:*

Bruce Lehman

BRUCE LEHMAN

*Attesting Officer*

*Commissioner of Patents and Trademarks*